US007520204B2

(12) United States Patent
Williams et al.

(10) Patent No.: US 7,520,204 B2
(45) Date of Patent: Apr. 21, 2009

(54) ARTICLE COMPRISING A COMPOSITE COVER

(75) Inventors: Robert B. Williams, Nottingham, MD (US); James A. Waicukauski, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 678 days.

(21) Appl. No.: 10/975,895

(22) Filed: Oct. 28, 2004

(65) Prior Publication Data

US 2006/0096449 A1 May 11, 2006

(51) Int. Cl.
*F41F 3/04* (2006.01)

(52) U.S. Cl. ..... 89/1.817; 220/200; 220/203.08; 428/156; 428/158; 428/174

(58) Field of Classification Search ..... 89/1.817, 89/1.816, 1.815; 49/463; 220/560.01, 200, 220/203.08; 428/98, 156, 158, 174
See application file for complete search history.

(56) References Cited

U.S. PATENT DOCUMENTS

| | | | | |
|---|---|---|---|---|
| 4,498,368 | A * | 2/1985 | Doane | 89/1.817 |
| 4,895,061 | A * | 1/1990 | Baricos et al. | 89/1.818 |
| 5,375,503 | A * | 12/1994 | Breugnot et al. | 89/1.817 |
| 6,123,005 | A * | 9/2000 | Kuchta et al. | 89/1.817 |
| 6,311,604 | B1 * | 11/2001 | Foris et al. | 89/1.817 |
| 6,526,860 | B2 * | 3/2003 | Facciano et al. | 89/1.801 |

* cited by examiner

*Primary Examiner*—J. Woodrow Eldred
(74) *Attorney, Agent, or Firm*—DeMont & Breyer LLC

(57) ABSTRACT

The illustrative embodiment of the invention is a munitions canister having a cover that is impervious to a variety of environmental stresses. In the illustrative embodiment, the cover includes a layer of rubber, which overlies a layer of sectioned, impact-resistant foam, which overlies a dome-shaped, structural member, which overlies a layer of acoustical dampening foam.

22 Claims, 3 Drawing Sheets

ARTICLE COMPRISING A COMPOSITE COVER

The U.S. Government has a paid-up license in this invention can the right in Limited circumstances to require the patent owner to license others on reasonable terms as Provided for by the terms of Contract No. DASG60-00-C-0072 awarded by the U.S. Army.

FIELD OF THE INVENTION

The present invention relates generally to canistered systems and, more particularly, to covers for canistered systems.

BACKGROUND OF THE INVENTION

Munitions, such as missiles and rockets, are often launched from canisters. The canisters are typically round or square tubes that contain a munition, munition-launch hardware such as rails and/or sabots, and electronics for initiating launch. In addition to functioning as a launch system, the canisters provide environmental protection for the munition, simplify munition-handling issues, and provide an efficient and long-term munition-storage solution.

In order to provide full environmental protection for the munition and other components within the canister, the canister must be sealed. This is typically done using a cap or cover. The cover is ideally able to protect or isolate the munition from a variety of environmental factors, such as variations in humidity, temperature extremes, debris impact from transportation or from the launch of adjacent munitions, exposure to water, icing, electromagnetic interference, etc. Furthermore, the cover is preferably resistant to degradation from the nuclear, biological and chemical decontaminants, corrosion, flame, and pressure. Also, it is desirable for the cover to provide some degree of acoustical dampening. And, importantly, the canister cover must provide unimpeded passage of the munition upon launch.

Several types of canister covers are known. One type comprises a flexible membrane that is stretched over a frame that is permanently attached to the canister. Upon launch, the munition tears through the membrane. Disadvantages of this type of cover are that it has relatively limited durability, offers minimal environmental protection, and is an inefficient storage solution due to the space required for the frame that attaches the membrane to the canister.

A second type of canister cover is a hard cover, typically made of plastic or metal, which is bonded to the canister. Upon launch, the cover is blown off the canister due to launch pressure or the forward motion of the munition. In some versions of this cover, the cover is scored to enable it to break into a predetermined number of pieces having a desired size. Drawbacks of this cover include a requirement that the launch pressure be relatively high to break the cover or the bond between the cover and the canister, inconsistent breaking of the bond between the cover and the canister, damage to the munition caused by impact with the cover, and damage to launch equipment due to cover fragments.

A third type of canister cover is a foamed plastic cover, which incorporates a solid layer of plastic foam. Upon launch, the canistered munition strikes the cover, which then breaks into pieces. These covers disadvantageously provide a poor environmental seal because the foam is a porous material that has limited resistance to air or moisture. Furthermore, because foamed plastic is hard and brittle, it is difficult to attach it to a canister without breaking or cracking the foam.

A fourth type of canister cover is a glass cover. The glass is heat treated so that it becomes frangible (i.e., a small point load will completely shatter it). The size of the shattered pieces can be predetermined and controlled by varying the heat treatment. But a cover formed of tempered glass has low overall durability due to the ease with which the glass can shatter. For example, such a cover will typically fail when exposed to hail. Furthermore, the glass fragments can interfere with launch of the munition by becoming wedged between the munition and the inner surface of the canister. Additionally, glass fragments can also scratch the surface of the munition, which might affect its aerodynamics.

Although known canister covers provide a varying measure of protection against at least some of environmental conditions, none of them are able to satisfy all of the internal and external environmental requirements pertaining to:

- extremes of temperature;
- nuclear, biological, and chemical ("NBC") decontaminants;
- hail impact;
- electromagnetic interference ("EMI");
- low vapor permeability;
- corrosion resistance and flammability;
- acoustical dampening;
- internal and external pressure containment; and
- limitations on the outgassing of internal materials (e.g., TML<1.0%, CVCM<0.10%) IAW ASTM E595.

SUMMARY OF THE INVENTION

The illustrative embodiment of the present invention is a munitions canister having a cover that avoids at least some of the drawbacks of the prior art. In particular, in the illustrative embodiment, the cover meets internal and external environmental requirements relating to:

- terrestrial service temperature;
- NBC decontaminants;
- hail impact;
- EMI;
- vapor permeability;
- corrosion resistance and flammability;
- acoustical dampening;
- internal and external pressure containment; and
- outgassing.

In the illustrative embodiment, the cover comprises multiple layers of materials that collectively provide protection from or resistance to the various environmental factors listed above. In the illustrative embodiment, the cover includes a layer of rubber, which overlies a layer of impact-resistant foam, which overlies a dome-shaped, structural member, which overlies a layer of acoustical dampening foam.

The layer of rubber is the outermost layer of the cover; that is, it is exposed to the ambient environment. This layer, and other exterior features of the cover, are coated with a paint that imparts resistance to attack by NBC decontaminants.

The layer of impact-resistant foam, which underlies the layer of rubber, absorbs and dampens the force of impact from hail or debris, thereby protecting the underlying, somewhat brittle, domed structural member. A previous cover design that did not include the impact-resistant foam, but did include a rubber layer, did not meet the hail impact requirement. In particular, the cover did not survive hail comprising ice balls of not greater than 51 millimeters in diameter, with a specific gravity of 0.9, a terminal velocity of 24 meters per second, and a hardness of 2 to 4 on the Mohs scale. The layer of impact-resistant foam is also advantageously flame retardant, anti-static, and provides thermal insulation.

The structural member, which is beneath the layer of impact-resistant foam, is engineered to withstand and contain a positive pressure that often exists in the munitions canister. In the illustrative embodiment, the structural member is formed into a dome shape, which is an efficient shape for resisting pressure. In other words, to withstand a given amount of pressure, a structural member having a domed profile can be thinner than a structural member having a flat surface profile. In the illustrative embodiment, the structural member is a composite material comprising high-modulus carbon fiber with a fiberglass galvanic isolation layer, and includes a layer of aluminum, which is vapor deposited. The aluminum functions as an EMI shield. Since the aluminum is vapor deposited, as opposed to being in the form of a foil layer as in some prior art covers, it also is effective as a vapor barrier.

In the illustrative embodiment, the innermost layer is an acoustical dampening foam. This layer, which is optional, is intended to reduce the noise that is generated at launch of the canistered munition.

The layer of rubber, the layer of impact-resistant foam, and the layer of acoustical-dampening foam are physically adapted to ease egress of the munition upon launch. In particular, the rubber and acoustical-dampening foam layers are scored and the impact-resistant foam is sectioned.

DETAILED DESCRIPTION

The illustrative embodiment of the present invention is a munitions canister with a cover that incorporates multiple layers of material. This multi-layer cover is useful in a variety of applications as well. For example, among other uses, the multi-layer cover is finds application as a missile-launcher opening cover, a cover for a pressurized storage vessel, an armament shipping-container cover, a transportation-container cover, and a hatch opening cover.

Figure 1:
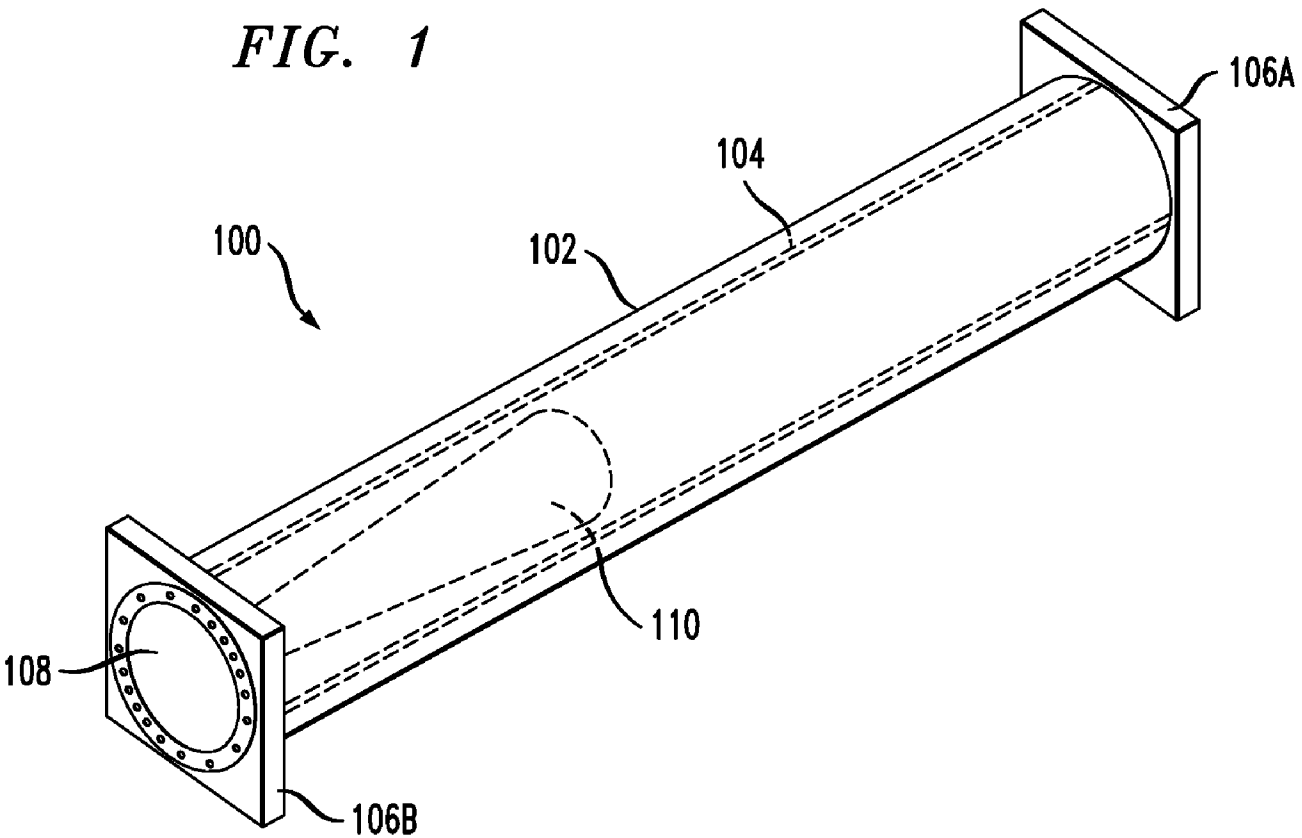
FIG. 1 depicts a munitions canister with a cover in accordance with the illustrative embodiment of the present invention.

FIG. 1 depicts munitions canister 100. The munitions canister includes structural shell 102, internals 104, end frames 106A and 106B and multi-layer cover 108.

Shell 102 is typically formed of a filament wound material, such as graphite/epoxy, etc. In some embodiments, shell 102 has a layer of foam insulation for thermal protection and a fiberglass outer wrap to increase resistance to damage.

Munitions canister 100 usually includes a variety of internals, indicated generally at 104. The internals include, for example, rails and rail cars to guide a munition during egress from shell 102. Other internals 104 include a slide-in cable tray and a self-adjusting snubber assembly to isolate the munition from shock and vibration. Those skilled in the art are familiar with the internal elements of a munitions canister and will know how to make and use them.

The ends of shell 102 are terminated with an end frame: 106A and 106B. End frame 106A provides an interface to a launcher (not shown). End frame 106B serves as a frame or support for cover 108. Munition 110 is depicted in shell 102.

Figure 2B:
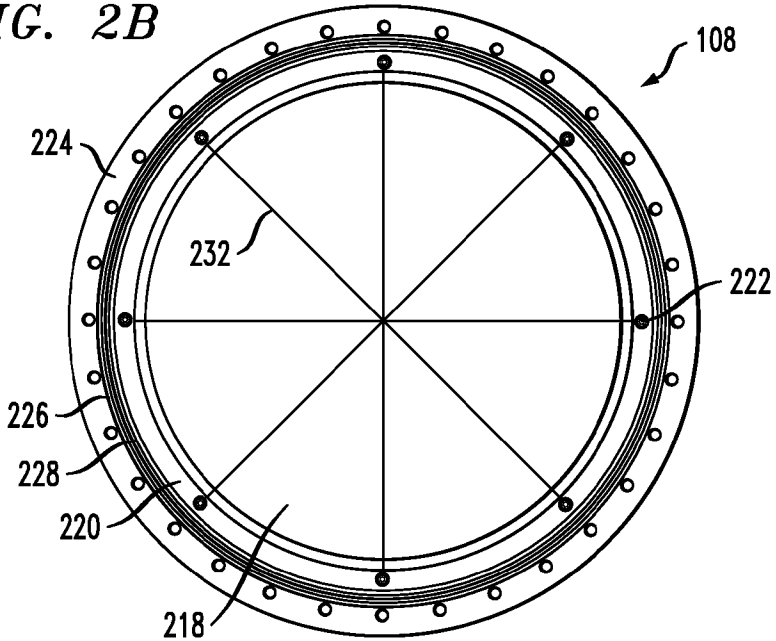
FIG. 2B depicts a bottom view of the cover of FIG. 2A.
Figure 2A:
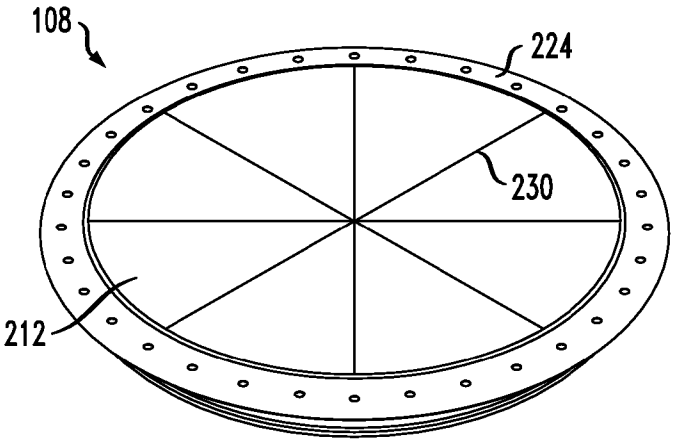
FIG. 2A depicts a perspective view of the cover for the canister.
Figure 2C:
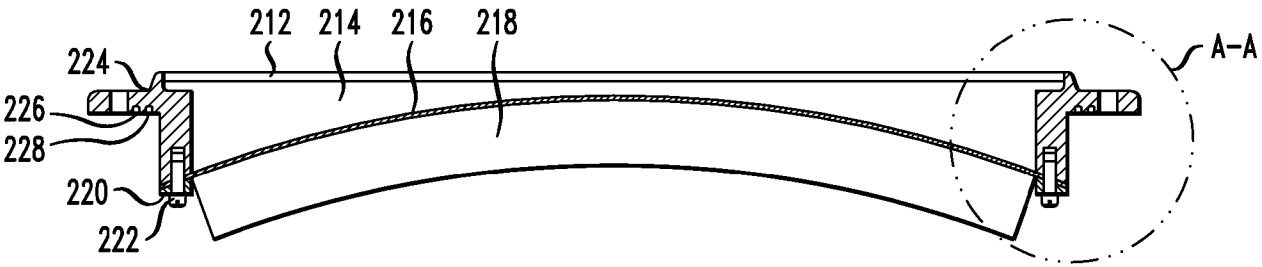
FIG. 2C depicts a cross-sectional view of the cover of FIG. 2A.

FIGS. 2A, 2B, and 2C depict a top perspective view, a bottom view, and a cross-sectional view, respectively, of the salient features of the illustrative embodiment of cover 108.

Referring now to the illustrative embodiment that is depicted in FIGS. 2A through 2C, cover 108 includes multiple layers of material. In particular, cover 108 includes layer 212 of rubber, layer 214 of impact-resistant foam, structural member 216, and layer 218 of acoustical dampening foam. Layer 212 of rubber is the outermost layer of cover 108 (exposed to the ambient environment) and layer 218 of acoustical dampening foam is the innermost layer of cover 108; that is, layer 218 is adjacent to munition 110 within structural shell 102.

The various layers 212 through 218 of cover 108 are bonded to one another using an adhesive, for example. Any of a variety of low-outgassing adhesives may suitably be used. For example, in some embodiments, layer 212 and layer 214 are bonded together using Loctite® Hysol EA9394, layer 214 and layer 216 are also bonded together using Loctite® Hysol EA9394, and layer 216 and layer 218 are bonded together using Loctite® Hysol EA9396. Loctite® brand surface adhesives are commercially available from Henkel Surface Technologies of Madison Heights, Mich. and their local distributors. In some embodiments, to further reduce outgassing from these already low-outgassing adhesives, the adhesive bonds are baked to a Total Mass Loss (TML) of <1.00% and Collected Volatile Condensable Material (CVCM)<0.10% as tested IAW ASTM E595.

As depicted in FIGS. 2A and 2B, uppermost layer 212 is scored (see score lines 230) and lowermost layer 218 is scored (see score lines 232). Additionally, layer 214 is sectioned into eight wedge-shape regions (not depicted). These eight sections are pressed tightly together, but are not bonded to one another. The purpose of the scoring and sectioning is to facilitate the passage of a munition through these layers at launch. That is, these layers are scored or sectioned so that they readily yield (e.g., rip, tear, break apart, etc.) upon contact with the munition. Structural member 216 is not scored or sectioned since it is relatively fragile and shatters when struck by the munition during launch. Score lines 230 and 232 from respective layers 212 and 218 are aligned with one another and with the breaks between the various sections of layer 214.

Figure 3:
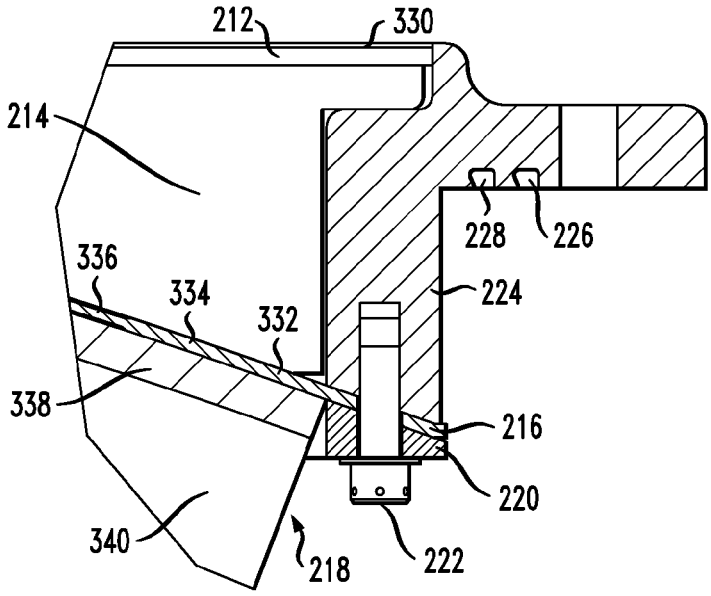
FIG. 3 depicts an enlargement of portion A-A of FIG. 2C.

As depicted in FIG. 2C and also in FIG. 3 (enlarged view of Section A-A of FIG. 2C), structural member 216 is coupled, via support ring 220 and fasteners 222 (e.g., bolts, etc.), to mounting frame 224. Since layers 212, 214, and 218 are bonded, either directly or indirectly, to structural member 216, they are likewise coupled to mounting frame 224.

Support ring 220, fasteners 222, and mounting frame 224 are advantageously formed from aluminum to resist corrosion, etc. Mounting frame 220 has grooves 226 and 228, which each receive a seal (e.g., o-ring, etc.) for environmental and EMI shielding.

As shown in FIGS. 2C and 3, layer 212 of rubber overlies layer 214 of impact-resistant foam, which overlies structural member 216 which, in turn, overlies layer 218 of acoustical dampening foam. As used in this description and the appended claims, the term "overlie" and its inflected forms means a position in relation to the ambient environment, wherein the "overlying" layer is closer to the ambient environment than the layer that it overlies. It is implicit in this definition that the object being described (i.e., cover 108) is in use as intended (e.g., sealing the end of a munitions canister, sealing a pressure vessel, etc.)" So, in the context of cover 108 serving as a closure for canister shell 102, if a first layer is described as overlying a second layer, then the first layer is closer to the ambient environment and the second layer is closer to the interior of the shell (or extends further into the shell). The terms "outermost" and "innermost" are defined for use herein in a similar fashion, wherein "outermost" means closest to the ambient environment and "innermost" means furthest into the interior (of shell 102, etc.).

When cover 108 is in place, layer 212 of rubber is the outer-most layer and is exposed to the ambient environment. (See, e.g., FIGS. 1 and 2A.) For that reason, layer 212 must be resistant to a variety of environmental stresses.

In some embodiments, layer 212 comprises EPDM rubber. EPDM is the name given to the class of synthetic rubbers made primarily from Ethylene Propylene Diene Monomer. EPDM rubber has a very-high resistance to heat, air pollution, and NBC decontamination solutions, and therefore offers a high degree of protection from environmental stresses to underlying layers and to the contents of shell 102. When formed of EPDM, layer 212 also serves as an ablative from plumes from adjacent launches. EPDM rubber is commercially available from R.E. Darling Co., Inc., of Tucson, Ariz., and others.

In some embodiments, layer 212 is about 3.2 millimeters thick and is scored to about 90 percent of its thickness (i.e., about 2.9 millimeters). Layer 212 is constrained to a minimum thickness of about 3 millimeters due to the ablation that occurs from the plumes when adjacent munitions are launched. Increasing the thickness of the layer increases, cost, weight and overall length of munitions canister 100.

To improve the protection offered by cover 108, and in particular by layer 212 of rubber, a film 330 (FIG. 3) of paint is applied to layer 212. The paint, which is referred to in this description and the appended claims as a "NBC-decontaminant-resistant paint," is resistant to attack by NBC decontaminants (e.g., Decontaminating Solution Number 2 ["DS2"], such as used by the military, etc.). The paint comprises an epoxy primer IAW MIL-P-53022, Type II, and Chemical Agent Resistant Coating ("CARC") IAW MIL-C-53039 applied IAW MIL-DTL-53072. The primer and paint is commercially available from Hentzen Coatings, Inc. of Milwaukee, Wis.

Beneath layer 212 is layer 214 comprising impact-resistant foam. A function of this layer is to protect underlying structural member 216 from impacts that would otherwise damage it, since the structural member is relatively brittle. This impact-resistant foam is different than the various rubber and elastomer layers used in prior-art covers. While those prior art rubber and elastomer layers would be sufficient to protect structural member 216 from damage due to the booster plumes of adjacent munitions, they are incapable of reliably protecting structural member 216 from physical strikes, such as impact from hail. In fact, testing has shown that layer 214 of impact-resistant foam must be present for cover 108 to reliably survive hail impact as per requirements (i.e., ice balls≦51 millimeters in diameter, sp. grav. 0.9, terminal velocity of 24 m/s, and a hardness of 2 to 4 on the Mohs scale).

One type of impact-resistant foam that has been found to be suitable for use in conjunction with the illustrative embodiment of the present invention is high-density, closed-cell, polyethylene foam. The foam should have a density of at least about 9.5 pounds per cubic foot (A-A-59136 Class I, Grade D, Type V) and should be able to withstand an impact of about 10 pounds per square inch. The impact-resistant foam must be able to dampen the force of, for example, hail impact, and be able to withstand multiple (hail) strikes.

Silicon sponge rubber, both medium and firm, was tested and did not provide enough dampening to prevent cracking in the structural member during hail-impact testing. Furthermore, structurally rigid foams, such as polymethacrylimide closed-cell rigid foam, was tested. These foams tended to pulverize when impacted by hail. Consequently, these foams were unable to protect against multiple hail strikes.

One impact-resistant foam that was capable of adequately dampening the force of hail impact on underlying structural member 216 and also capable of withstanding multiple strikes due to its low compression set, is Ethafoam™ brand polyethylene foam packaging, product designation M5 FR A/S, which is commercially available from DOW Performance Foams (Dow Chemical Company) of Midland, Mich.

In addition to being able to protect underlying structural member 216, Ethafoam™ M5 FR A/S is fire retardant. This substantially reduces the risk that foam, which fractures during munitions launch, will start fires in the field. Furthermore, Ethafoam™ M5 FR A/S is anti-static, so there is a reduced likelihood of electrostatic discharge. This type of discharge can affect the munition as it penetrates cover 108.

Layer 214 of impact-resistant foam is advantageously sectioned to facilitate fly-through of a munition. More particularly, in the illustrative embodiment, layer 214 comprises eight distinct wedges of impact-resistant foam that are packed tightly together. In some other embodiments, fewer or more than eight wedges are used. In the illustrative embodiment, the wedges of impact-resistant foam are not bonded together. As previously described, the breaks between the various sections of layer 214 align with score lines 230 and 232 from respective layers 212 (rubber) and 218 (acoustical dampening foam).

The thickness of layer 214 of impact-resistant foam varies since it is machined to match the convex surface of structural member 216 (see FIG. 2C). Layer 214 is thinnest at its center (i.e., the apex of structural member 216). In the illustrative embodiment, the center thickness of layer 214 is nominally 8.75 millimeters. The desired minimum thickness of layer 214 is a function of the thickness of layer 212 of rubber and the strength and shape of structural member 216, since these attributes, as well as the thickness of layer 214 itself, contribute to the ability of structural member 216 to resist cracking on impact from hail, etc.

Figure 4:
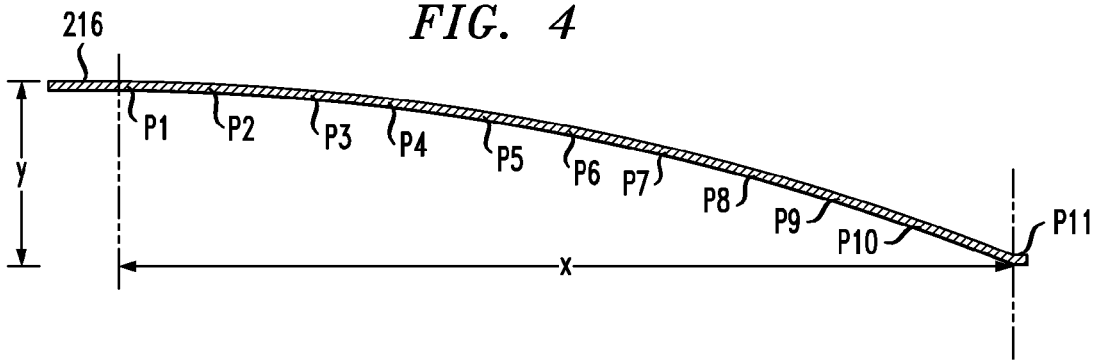
FIG. 4 depicts the structural member, which is one of several layers that compose a cover in accordance with the illustrative embodiment of the present invention.

Below layer 214 is structural member 216. The basic function of the structural member is to contain greater-than-atmospheric pressure levels within shell 102. To that end, structural member 216 is formed to have a "dome" shape, as depicted in FIGS. 2C and 4. The dome shape is more efficient than a flat profile for resisting pressure. As a consequence of the dome shape, relatively less material is used to form the structural member (to resist a given amount of pressure) than would be used in a composite having a surface flat profile.

In the illustrative embodiment depicted in FIG. 5, structural member 216 comprises a high-modulus carbon-graphite fiber in a cyanate-ester matrix. In some embodiments, the matrix comprises Bryte EX-1515/M553 prepreg (cyanate ester) and Bryte EX-1516 film adhesive (cyanate ester). These materials are commercially available from Bryte Technologies Inc. of Morgan Hill, Calif. Structural member 216 can be fabricated by a company that offers composite-materials processing, such as Mission Research Corporation of Dayton, Ohio, or others.

Structural member 216 also incorporates a thin layer of fiberglass that provides galvanic isolation between the structural member and aluminum support ring 220 and mounting frame 224. Furthermore, in the illustrative embodiment, a layer of aluminum (not depicted) is deposited on structural member 216 to provide a barrier to EMI. Unlike the prior art, which typically incorporates aluminum as a layer of foil, the aluminum layer in cover 108 is ion-vapor deposited onto the structural member 216. More particularly, the aluminum layer is deposited on the concave side of structural member 216 as well as on portions of support ring 220 and mounting frame 224 to create the Faraday cage required for EMI protection. Depositing the aluminum in this fashion eliminates the use of conductive adhesives (to bond aluminum foil to the appropriate layers), which can degrade during the twenty-year service life of munitions canister 100. A secondary benefit of vapor deposition is that the aluminum layer is effective as a vapor barrier as well. The aluminum is deposited to a thickness of about 1.5 to 2.0 mils.

TABLE 1

Thickness and Radius of Curvature of Structural Member 216

| POINT | THICKNESS <MM> | X COORDINATE (RADIUS) <MM> | Y COORDINATE <MM> |
|---|---|---|---|
| P1 | 1.22 | 0 | 50.00 |
| P2 | 1.22 | 25.4 | 50.29 |
| P3 | 1.22 | 50.4 | 48.77 |
| P4 | 1.22 | 76.2 | 46.23 |
| P5 | 1.22 | 101.6 | 42.67 |
| P6 | 1.22 | 127.0 | 38.10 |
| P7 | 1.22 | 152.4 | 32.51 |
| P8 | 1.22 | 177.8 | 25.91 |
| P9 | 1.63 | 203.2 | 18.29 |
| P10 | 2.03 | 228.6 | 9.65 |
| P11 | 2.03 | 251.7 | 1.10 |

The thickness and radius of curvature of structural member 216 varies as a function of radial distance from its centerline. These parameters of structural member 216 are determined based on material properties and pressure requirements. As depicted in FIG. 3, structural member 216 is relatively thicker near its perimeter. In particular, it is relatively thickest at region 332, somewhat less thick at region 334, and thinnest at region 336. FIG. 4, in conjunction with Table 1 above, provides the thickness of structural member 216 as a function of radius and also provides an indication of radius of curvature via Cartesian coordinates.

Layer 218 of acoustical dampening foam, which is optional, is intended to reduce the noise on launch. Any of a variety of foams are suitable for this service. The thickness of layer 218 is a function of the attenuation provided per unit thickness of the specific foam and the desired amount of overall attenuation. In the illustrative embodiment layer 218 has a thickness of about 38 millimeters and is scored to at least about 80 percent of its thickness (e.g., 31 millimeters, etc.)

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An article comprising a cover, wherein said cover comprises:

a first layer comprising a unitary structural member having a dome shape, wherein the structural member is not scored; and a second layer comprising an impact-resistant, closed-cell foam suitable for protecting the first layer from physical strikes from an ambient environment; wherein:

(a) said second layer overlies and is bonded to said first layer; and (b) said second layer comprises a plurality of discrete segments.

2. The article of claim 1 wherein said article is a munitions canister, and wherein said cover is coupled to an end of said munitions canister.

3. The article of claim 2 wherein said second layer has a first major surface and a second major surface, and wherein said second major surface is proximal to said first layer, and further wherein said first major surface is substantially flat.

4. The article of claim 1 wherein said first layer is relatively thicker near a perimeter thereof and relatively thinner near a center thereof.

5. The article of claim 1 wherein said structural member comprises carbon-graphite fiber.

6. The article of claim 1 further comprising a vapor-deposited film, wherein said vapor-deposited film is deposited on a concave surface of said structural member, and wherein said film comprises aluminum.

7. The article of claim 1 wherein said impact-resistant foam has a density of at least about 9.5 pounds per cubic foot and is able to withstand an impact of at least about 10 pounds per square inch.

8. The article of claim 1 wherein said impact-resistant foam is relatively thicker near a perimeter thereof and relatively thinner near a center thereof.

9. The article of claim 1 further comprising a third layer, wherein said third layer overlies said second layer, and wherein said third layer comprises rubber.

10. The article of claim 9 further comprising a fourth layer, wherein said first layer overlies said fourth layer, and wherein said fourth layer comprises acoustical dampening foam.

11. An article comprising a cover, wherein said cover has an outer surface and an inner surface, and wherein said cover comprises:

a structural member having a domed shape, wherein said structural member is recessed from said outer surface and wherein said structural member is relatively thicker proximal to a perimeter thereof and relatively thinner proximal to a center thereof; and at least one layer that overlies said structural member, wherein said at least one layer comprises impact-resistant, closed-cell foam.

12. The article of claim 11 wherein said outer surface of said cover is flat.

13. The article of claim 11 wherein said outer surface comprises synthetic rubber made from Ethylene Propylene Diene Monomer.

14. The article of claim 11 wherein said inner surface comprises acoustic foam.

15. The article of claim 11 further comprising a layer of vapor-deposited aluminum, wherein said aluminum is vapor-deposited on said structural member.

16. The article of claim 11 wherein said at least one layer is relatively thicker proximal to a perimeter thereof and relatively thinner proximal to a center thereof.

17. An article comprising a cover, wherein said cover comprises:

a first layer comprising a structural member having a dome shape; and a second layer comprising an impact-resistant, closed-cell foam, wherein said second layer overlies and abuts said first layer; and a third layer comprising rubber, wherein the third layer overlies and abuts said second layer.

18. The article of claim 17 wherein said structural member is relatively thicker proximal to a perimeter thereof and relatively thinner proximal to a center thereof.

19. The article of claim 18 further comprising a fourth layer, wherein said first layer overlies and abuts said fourth layer, and wherein said fourth layer comprises acoustical dampening foam.

20. The article of claim 18 further comprising a vapor-deposited film, wherein said vapor-deposited film is deposited on a concave surface of said structural member, and wherein said film comprises aluminum.

21. The article of claim 18 wherein an outermost surface of the cover is flat.

22. An article comprising a cover, wherein said cover comprises:

a first layer comprising a structural member having a dome shape;

a second layer comprising an impact-resistant, closed-cell foam, wherein:

(a) a lower surface of the second layer abuts an upper surface of the first layer;

(b) said lower surface of the second layer is domed to match the dome shape of the structural member;

(c) an upper surface of the second layer is flat; and a third layer comprising rubber, wherein the third layer is flat and overlies and abuts the upper surface of said second layer.

* * * * *